United States Patent [19]

Decker et al.

[11] Patent Number: 4,894,915

[45] Date of Patent: Jan. 23, 1990

[54] CABLE DRIVEN RING BLADE KNIFE

[75] Inventors: Richard B. Decker; Richard P. Bozzi, both of Vermilion, Ohio

[73] Assignee: Bettcher Industries, Inc., Vermilion, Ohio

[21] Appl. No.: 9,061

[22] Filed: Feb. 11, 1987

Related U.S. Application Data

[63] Continuation-in-part of Ser. No. 842,131, Mar. 20, 1986.

[51] Int. Cl.[4] ..... B26B 25/00

[52] U.S. Cl. ..... 30/276; 17/1 G

[58] Field of Search ..... 30/276, 286, 347; 17/1 G

[56] References Cited

U.S. PATENT DOCUMENTS

| | | |
|---|---|---|
| Re. 25,947 | 12/1965 | Bettcher . |
| 2,139,272 | 12/1988 | Jaworski . |
| 2,827,657 | 3/1958 | Bettcher . |
| 3,269,010 | 8/1966 | Bettcher . |
| 3,688,403 | 9/1972 | Bettcher . |
| 3,852,882 | 12/1974 | Bettcher . |
| 4,142,291 | 3/1979 | Bettcher . |
| 4,166,317 | 9/1979 | Bettcher . |
| 4,170,063 | 10/1979 | Bettcher . |
| 4,175,321 | 11/1979 | Bettcher . |
| 4,178,683 | 12/1979 | Bettcher . |
| 4,198,750 | 4/1980 | Bettcher . |
| 4,236,531 | 12/1980 | McCullough . |
| 4,324,043 | 4/1982 | McCullough . |
| 4,363,170 | 12/1982 | McCullough . |
| 4,494,311 | 1/1985 | McCullough . |
| 4,516,323 | 5/1985 | Bettcher et al. . |
| 4,575,937 | 3/1986 | McCullough . |
| 4,575,938 | 3/1986 | McCullough . |

FOREIGN PATENT DOCUMENTS

| | | |
|---|---|---|
| 3446161 | 1/1986 | Fed. Rep. of Germany . |
| 21387 | 5/1961 | German Democratic Rep. . |
| 1172781 | 8/1985 | U.S.S.R. . |

*Primary Examiner*—Frank T. Yost
*Assistant Examiner*—Willmon Fridie, Jr.
*Attorney, Agent, or Firm*—Watts, Hoffmann, Fisher & Heinke

[57] ABSTRACT

A rotary hand knife that includes a handpiece 12, 12', 220 a ring-like housing 14 on the handpiece, and a rotary ring blade 16 supported and guided by the housing. The blade is driven by a pinion 18, 18', 18" rotated by a motor-driven flexible cable assembly 24, 24', 24". A removable body 58, 58', 128, 258 in the handpiece is movable manually within the handpiece to control whether or not the cable drive rotates the pinion. A spring 94, 94', 94" within the handpiece yieldably biases the body to a position where the pinion is not driven and a hand-engageable member 120, 120', 120" retains the body in a position where the pinion is driven against the force of the spring when the handpiece and hand-engageable member are gripped.

17 Claims, 5 Drawing Sheets

CABLE DRIVEN RING BLADE KNIFE

This application is a continuation-in-part of application Ser. No. 842,131, filed Mar. 20, 1986.

DESCRIPTION

1. Technical Field

The invention relates to hand knives of the type that have a rotary ring blade and that find primary use for trimming meat and removing meat from bones.

1. Background Art

Hand knives having ring-like rotary blades have been used for some time in packing houses, meat distribution or wholesale houses and the like, for boning and trimming meat products. The blades are rotated by relatively large remote electric motors connected to the knives by flexible shaft drives. Such prior art knives are disclosed in Bettcher U.S. Pat. Nos. 2,827,657 and 3,269,010. Because these knives are used largely in damp locations to work on moist meat products, the on-off switch for the drive motor is not located at the handpiece, which could subject an operator to an electrical shock in the event of a malfunction of the electric system, such as a short circuit in the motor, but rather the switch is located at the remote motor. This makes it somewhat inconvenient for the operator to momentarily start and stop the knife. Moreover, merely switching off the electric power to the motor does not immediately stop the blade rotation, because the drive motor is large and the momentum of the large motor armature continues to rotate the blade for a short time.

DISCLOSURE OF THE INVENTION

The invention provides a novel and improved hand knife having a cable-driven rotary cutting blade that has a hand gripped member that, when released, allows automatic disengagement of a drive connection between a flexible drive cable and the blade. Thus, anytime the handpiece is set down, dropped or otherwise not gripped by an operator, rotation of the drive cable will not rotate the knife blade. Because the blade is extremely light and encounters friction in its support structure, it has little or no tendency to continue rotating when disconnected from the cable.

More specifically, the invention provides a novel and improved hand knife having a rotary ring blade supported in a housing on a handpiece, a rotary blade-driving member supported by the handpiece and engaged with the blade, and a mechanism in the handpiece for selectively coupling a rotary cable drive with the blade-driving member. The mechanism includes a reciprocable member movable between two positions, one where the cable drive is coupled with the blade-driving member and one where it is not. The member is biased to the latter position. A hand-engageable element retains the member in the position where the cable drive is coupled, against the bias, when the handpiece and element are gripped.

Further features and advantages of the invention will be described in the detailed description that follows, with reference to the accompanying drawings.

BRIEF DESCRIPTION OF DRAWINGS

FIG. 4 is an end elevational view of the hand knife of FIG. 2 taken from the left hand side and showing the section line 2–2 along which FIG. 2 is taken;

BEST MODE FOR CARRYING OUT THE INVENTION

Figure 1:
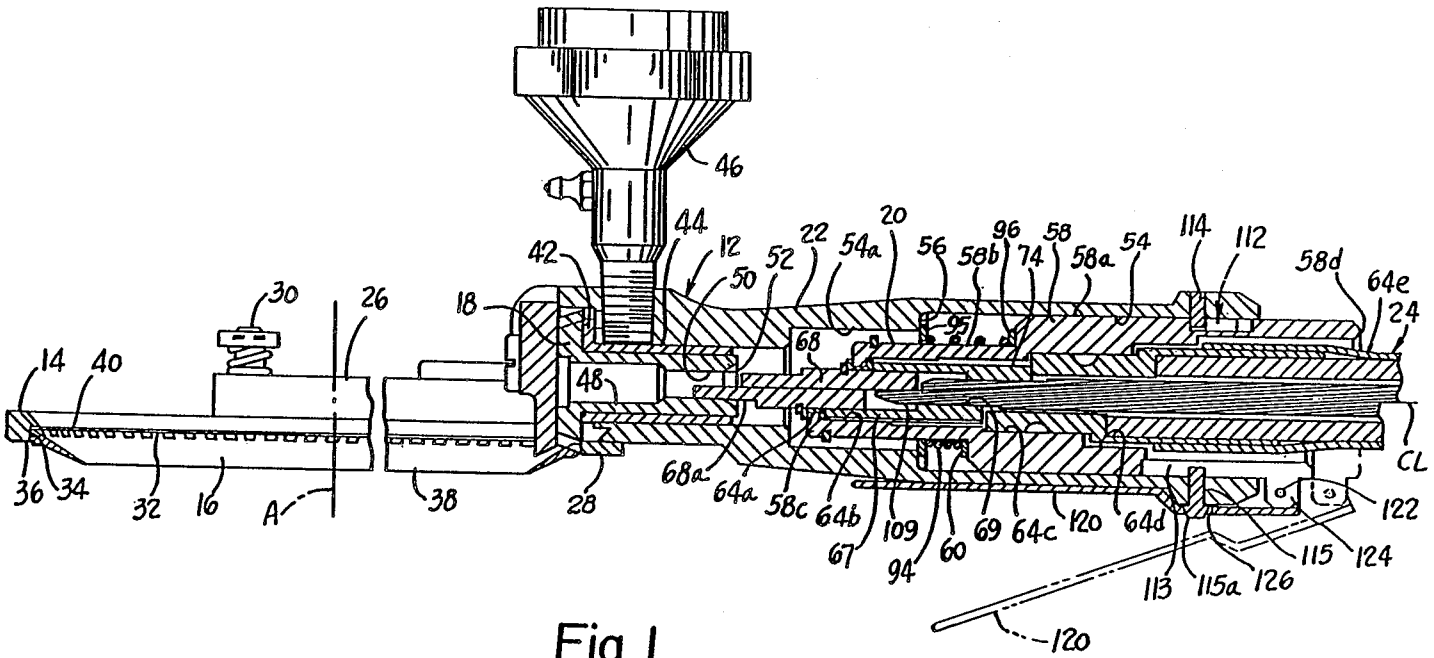
FIG. 1 is a longitudinal sectional view of a hand knife embodying the present invention, with internal parts diagrammatically divided along a centerline CL, showing one position of the parts in the upper half and another position in the lower half.

With reference to the drawings, a hand knife 10 is shown in FIGS. 1–6 as one embodiment of the present invention. It is comprised of a handpiece 12, a ring-like blade housing 14, a rotary ring blade 16 supported about its periphery by the housing for relative rotation, a blade-driving pinion 18, a removable drive transmission 20 received in a handle portion 22 of the handpiece, and a flexible cable drive 24 connected to the transmission. The transmission is movable toward and away from the pinion to selectively transmit or not the rotary motion of the cable drive 24 to the pinion.

The handpiece 12 shown is of the type disclosed in U.S. Pat. No. 4,492,027, which finds principal use in slicing surface skin, fat or meat from meat products. The invention is equally applicable to a handpiece of the type shown in U.S. Pat. No. 4,509,261, which finds principal use in trimming meat from bones or for other trimming operations. The handpiece 12 has an arcuate portion 26 at the end of the handle portion to support the housing 14. A blade retaining shoe 28 is pivotably secured at one end to the arcuate portion 26 by a pivot 30. The blade housing 14 captures the blade 16 peripherally about a portion remote from the handpiece while the shoe 28 captures the blade adjacent the handpiece and pivots out of position to allow blade removal. The housing provides a flat surface 32, a peripheral surface 34 and a lip 36 against all of which the blade slides when the blade is pushed against and drawn through a product.

The ring blade 16 is frusto-conical in shape and has a cutting edge 38 at one axial end and gear teeth 40 at the other. The gear teeth ride within the housing and mesh with teeth of the drive pinion 18, causing the blade to rotate within the housing about a central axis A when the drive pinion is rotated.

The drive pinion 18 has an elongated hub 42 rotatably supported by a bearing sleeve 44 fixed in the handpiece 12. Lubrication is provided by a grease reservoir 46. The hub 42 has an internal bore 48 that has a portion 50 square in cross section and is counter sunk at 52 at the outer end.

The drive transmission 20 fits closely within a cylindrical cavity 54 of the handle portion 22, which has a shoulder 56 and a smaller diameter portion 54*a*. The transmission has a body 58, which in the preferred embodiment is of aluminum or plastic having two cylindrical portions, 58*a* of larger diameter and 58*b* of smaller diameter, with an external shoulder 60 between them. The portion 58*b* extends into the cavity portion 54*a* and terminates at an end 58*c*, while the portion 58*a* extends partially out of the cavity 54 beyond the handle portion of the handpiece and has an outer end 58*d*. The body 58 has a central through-bore 64 with five portions 64*a, b, c, d* and *e* of successively larger diameters from the inner end 58*c* to the outer end 58*d*. A rotary drive shaft 66, comprised of a cylindrical sleeve 67 and a rod 68 press fit together, the rod within the sleeve, is rotatably carried by the body 58.

The rod extends through the central bore portion 64*a* beyond the end 58*c* of the body and is cylindrical except for an end portion 68*a* that is square in cross section and tapered at its end to mate with portion 50 of the internal bore 48 of the pinion. The rod 68 rotates freely in the central bore portion 64*a* and has a retainer ring 70 (FIG. 2) that abuts a washer 71 at the end 58*c* of the body 58. One end 67*a* of the sleeve 67 abuts a similar washer 72, and the ring 70 and end 67*a* locate the drive shaft 66 in a fixed axial location relative to the body 58. The sleeve is supported for rotation in a sleeve bearing 74 fixed in the bore portion 64*b* of the body. The end of the sleeve 67 opposite from the rod has a square central bore 69 (FIG. 1) and the sleeve terminates at the juncture between the bore portions 64*b* and 64*c*.

Figure 2:
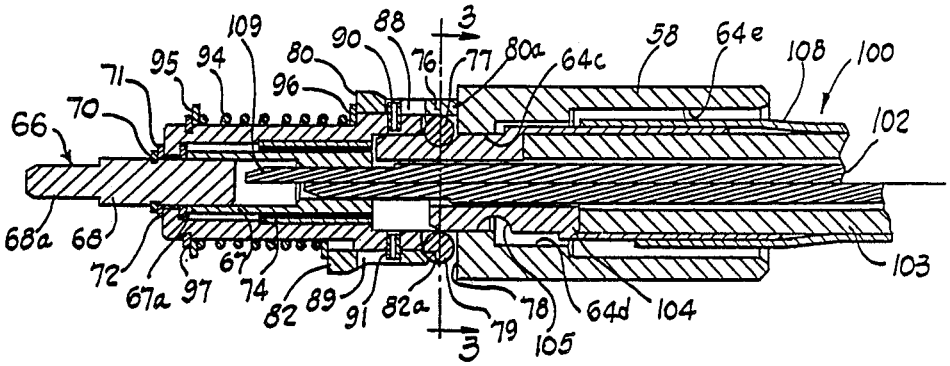
FIG. 2 is a partial longitudinal sectional view of the hand knife of FIG. 1 rotated 90° about the centerline.
Figure 3:
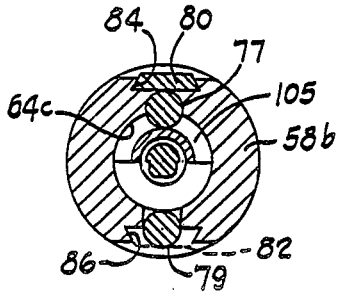
FIG. 3 is a cross sectional view of the hand knife of FIG. 2 taken along the line 3—3.
Figure 4:
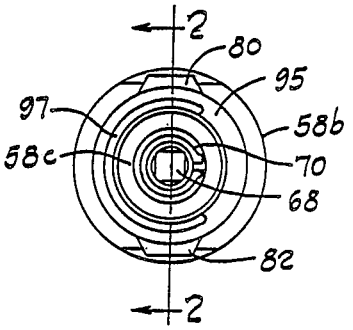

As best shown in FIGS. 2 and 3, the portion of the body 58 in which the bore portion 64*c* is formed has two diametrically opposite circular apertures 76, 78 in which detent balls 77, 79, respectively, are located and extend radially inward of the bore 64*c*. Two diametrically opposite slides 80, 82 are located over the apertures 76, 78, respectively, in longitudinally extending ways 84, 86, respectively. Each slide has a longitudinal slot 88, 89 that receives the extending end of a roll pin 90, 91 secured in the body, limiting motion of the slides. A coil compression spring 94 encircles the small diameter body portion 58*b*, between two slidable washers 95, 96. The washer 95 is retained by a snap ring 97 and the washer 96 by the shoulder 60 on the body. The spring is in a slightly compressed state when the washer 95 is against the snap ring 97. The washer 96 has an outside diameter sufficient to overlap the slides 80, 82 and hence the spring 94 urges the slides to a position over the detent balls. The slides have beveled ends 80*a*, 82*a* to urge the balls radially inward. In the top portion of FIG. 2 the slide is in a position that locates the ball partially within the internal bore 64*c*, while in the lower portion the slide is in a position that allows the ball to move out of the internal bore. The slides are constructed to be hand operable; i.e., movable without the need for tools.

The internal bore portions 64*c, d* and *e* are of sizes to accommodate the distal end of a flexible drive cable sheath 100 of the cable drive assembly 24 that carries a rotatable flexible drive cable 102 within it. The sheath is comprised of a plastic tubular body 103 secured at one end to the electric drive motor (not shown) and at the distal end having a tubular metal fitting 104 crimped onto the body 103 and having a circular external groove 105 located to receive the detent balls 77, 79 when the fitting is fully received in the bore portion 64*c*. A plastic reinforcing sleeve 108 surrounds a portion of the fitting and the distal end of the sheath. The cable 102 has an end 109 that is square in cross section to mate with the square central bore 69 of the drive shaft 66.

When the flexible cable drive 24 is secured in the body 58 as shown in the upper portion of FIG. 2, the square end 109 fits within the square bore 69 of the drive shaft. The axial length of the bore 69 is sufficient to accommodate the length of the cable end 109 that extends from the fitting 104 without longitudinal force being imparted; i.e., without the cable bottoming out and urging the shaft lengthwise. The cable assembly 24 is assembled to the body 58 with the body removed from the handpiece, as shown in FIG. 2. Once the cable assembly is secured, the body is slid into the bore 64 of the handle portion.

Figure 5:
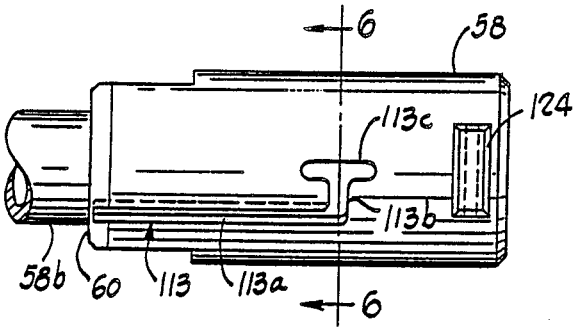
FIG. 5 is a side elevational view of a part of the structure shown in FIGS. 1 and 2 illustrating an external retaining groove.
Figure 6:
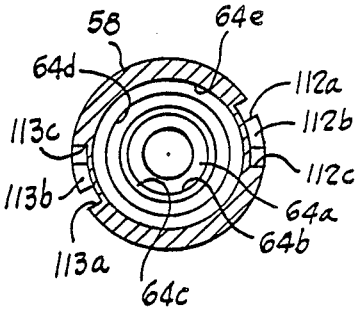
FIG. 6 is a cross sectional view of the structure shown in FIG. 5 taken along the line 6—6.

Receipt and retention of the body 58 in the bore 64 is facilitated by a pair of identical diametrically opposite external surface grooves 112, 113 that cooperate with two fixed pins 114, 115, respectively, in the handle portion, that extend into the bore 54. As shown in FIG. 5, the groove 113 has a longitudinal extending portion 113*a* that opens through the shoulder 60 and connects through a right angle portion 113*b* to a short parallel groove portion 113*c*. This allows the body to be received in the bore 54 with longitudinal movement. The body is then rotated to bring the pins 114, 115 into the parallel slot portions 112*c*, 113*c*, which then allows limited longitudinal reciprocation of the body relative to the handpiece with little or no likelihood of inadvertent disengagement.

When the body 58 is inserted into the handle, the washer 95 engages the internal shoulder 56 and the spring 94 is compressed during part of the body movement before the pins 114, 115 reach the groove portions 112*b*, 113*b* so that the spring applies a biasing force to the body at all times when the pins are in the groove portions 112*c*, 113*c*. As shown in FIG. 1, in the body position illustrated in the upper half, the pins 114, 115 are in the forward ends of the groove portions 112*c*, 113*c*, the spring 94 is partially compressed, and the drive shaft 68 is not engaged with the pinion 18. In the body position illustrated in the lower half, the pins 114, 115 are in the rearward ends of the groove portions 112*c*, 113*c*, the spring 94 is fully compressed, and the drive shaft 68 is engaged with the pinion 18 to impart rotation. The distal end of the square portion 68*a* of the drive shaft, received in the pinion, never bottoms-out, i.e., does not engage the pinion to apply an axial force. Thus, none of the rotating parts of the drive transmission are under any thrust load that would create a power loss or generate heat during operation.

The body 58 is manually moved to the forward position shown in the bottom half of FIG. 1 by an operator pushing on the cable drive assembly 24 (which has been reinforced for that purpose with the sleeve 108) and/or on the back end of the body, which extends from the handpiece. The body has been constructed to be received well within the handle portion to locate the fitting 104 as far forward as practical and to provide a clearance in the bore portion 64*e* with the cable drive to facilitate some flexing of the cable drive as close to the fitting as possible to allow some maneuvering of the knife about the fitting and hence essentially about the portion gripped in the hand.

The body is retained in the forward position shown in the bottom half of FIG. 1 by a lever 120 and the pin 115. The lever is pivoted at 122 on a boss 124 that extends from a portion of the body 58 that is external of the handle portion 22. The lever is shaped to extend along and adjacent the handle portion as shown in solid line in FIG. 1 and to be gripped by an operator when the operator holds the handpiece. An aperture 126 in the lever is in a position and of a size to closely receive a portion 115*a* of the pin 115 that extends externally of the handle portion. With this arrangement the operator need not physically and continuously overcome the force of the spring 94 with gripping force to retain the body in the forward driving position, but need only hold the lever tight enough to retain it against the handle portion once the body is initially moved to the forward position. Purposefully moving the body initially to the forward position takes significant force and requires use of both the operator's hands, one on the handle portion and the other on the cable drive to push the body forward. As a result, neither hand is in a position to be injured when the blade begins rotation.

The extending portion 115*a* of the pin 115 is frustoconical in shape to provide a camming action on the lever at the aperture 126 so the lever will be cammed to an open or releasing position (shown in phantom) under the force of the spring 94 if released by the operator, allowing the body to be moved immediately to the rearward position shown in the upper portion of FIG. 1 and in the phantom position in the lower portion of FIG. 1, disengaging the drive.

Figure 7:
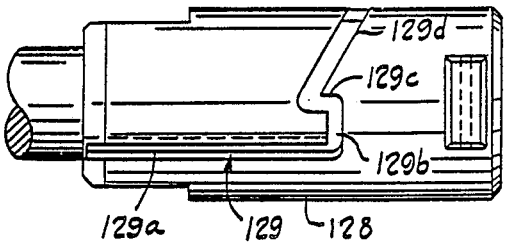
FIG. 7 is a side elevational view of a second embodiment of a part of the structure similar to that shown in FIG. 5, but with a modified external groove.

A modified body 128 similar to the body 58 is shown in FIG. 7 and as an alternative can be substituted for the body 58 in the handle portion 22. It is provided with two grooves 129, diametrically opposite each other and identical in shape. Only one groove 129 that cooperates with the pin 115 is shown. Each groove 129 has a straight portion 129*a*, and a circumferential portion 129*b* that are identical to the groove portions 113*a* and 113*b* shown in connection with the body 58. However, in place of the groove portion 113*c* that extends axially in opposite directions from the groove portion 113*b*, the body 128 has a groove portion 129*c* that extends only in one axial direction and then a portion 129*d* that extends helically in the other axial direction. As a result, once the body is received in the handpiece, first through axial movement, with the pins 114, 115 each received in one of the grooves 129, and then through rotary movement, during which the pins travel through portions 129*b* of each groove, the spring 94 will then urge the body axially away from the pinion, locating each pin 114, 115 at the juncture of the respective groove portions 129*c* and 129*d*. Now rotation of the body results in axial movement toward the pinion by virtue of the pins acting on the groove surfaces, carrying the drive cable shaft into engagement with the pinion. The lever 120 is located in a position on the body 128 where it will overlie the pin 115 when the body is rotated and driven forward to engage the drive shaft with the pinion. Thus, the tapered exterior portion 115*a* of the pin cooperates with the lever in the same manner as it does with the lever of the body 58.

Figure 8:
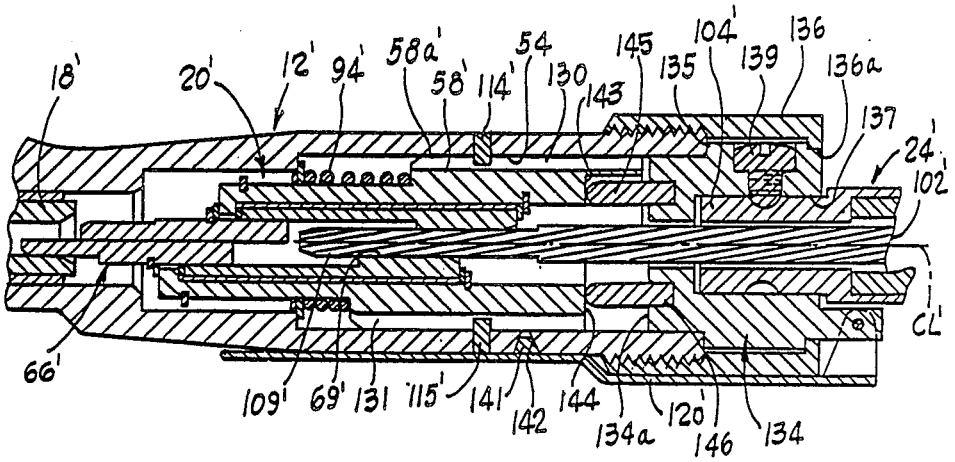
FIG. 8 is a partial longitudinal sectional view of another embodiment of the invention with internal parts diagrammatically divided along a centerline CL′, showing one position of the parts in the upper half and another position in the lower half.

A modified handpiece 12' is shown in FIG. 8 having a drive pinion 18' driven by a modified drive transmission 20'. Because of the basic similarities to the handpiece 12 and drive transmission 20, only the significant differences in structure and function of the modified handpiece and drive transmission will be described. For convenient comparison, parts of the modified handpiece and transmission that correspond with similar parts in the embodiment of FIGS. 1–6 are designated with the same reference numeral, but with a prime (') designation.

The transmission 20' has a body 58' within a cavity 54' of the handpiece. The body carries a drive shaft 66' for relative rotation but in fixed axial relationship. The drive shaft has a somewhat longer central bore 69' than that of the drive shaft 66 and receives a somewhat longer end 109' of the drive cable 102'. As in the previously described embodiment, the cable end and the bore are shaped to allow relative axial movement but not relative rotation when engaged. The body 58' is movable axially within the cavity relative to the handpiece and relative to the cable drive 24' to move the drive shaft into and out of driving engagement with the pinion 18'. During such movement, the cable 102' remains in a fixed axial position relative to the handpiece and the end 109' remains in the bore 69'. In place of the grooves 112 and 113 in the body 58, two straight, diametrically opposite, longitudinal grooves 130, 131 extend the length of the larger diameter body portion 58*a'* and receive pins 114', 115', which guide the body longitudinally and prohibit rotation.

A cable assembly adapter 134 with external surfaces of revolution is partially received and rotatable in the cavity 54', being located axially by a shoulder 135 and rotatably retained by a cap 136 threaded to the handpiece. The adapter extends through a central opening 136*a* in the cap and has a stepped central passage 137 that receives a fitting 104' of the cable drive and through which the cable 102' extends. The fitting is rotably retained in the adapter by a round-ended screw 139 received in a circumferential groove 105' of the fitting. A finger 140, extending axially from the adapter beyond the cap, pivotably supports a lever 120' that restrains rotation of the adapter when in a gripped position shown in FIG. 8. In that position a lever projection 141 seats within an aperture 142 in the handpiece to retain the body 58' in the forward driving position shown in the lower half of FIG. 8.

The body 58' has two diametrically opposite, helical, end cam surfaces 143, 144. A compression spring 94' biases the body rearwardly of the handpiece, away from the pinion, as shown in the upper portion of FIG. 8. Axial movement of the body 58' is controlled by two round-ended pins 145, 146 extending from the adapter 134. The pins extend forward from an end surface 134*a* of the adapter that faces toward the body and is adjacent to the cam surfaces. The pins each contact one cam surface 143, 144 at diametrically opposite locations. Rotation of the adapter 90° relative to the handle cams the body forward and rotation in the opposite direction allows the body to move rearward, engaging or disengaging the shaft 66' with the pinion 18'. The cam surfaces 143, 144 and pins 145, 146 are constructed to provide sufficient axial movement of the body and drive shaft that the drive shaft is moved into and out of engagement with the pinion when the adapter 134 is rotated through the range of movement allowed by the compression of the spring 94' in the forward position of the body and by end walls (not shown) that contact the pins 145, 146 at one end of each cam surface, which surfaces are in part recessed into the end of the body 58'.

The angle of each helical cam surface is identical and sufficiently steep that the axial force applied by the spring 94' will rotate the adapter if unrestrained. Thus, as soon as the lever is released, the adapter is free to rotate and does so in response to rearward movement of the body 58' caused by the spring 94', allowing disengagement of the drive shaft from the pinion. Both the projection 141 and the aperture 142 are frustoconical in shape or otherwise tapered to cam the projection out of the aperture in response to a rotational force on the adapter when the lever is released. Engagement of the drive shaft with the pinion is accomplished by manual rotation of the adapter 134, typically using the lever, to place the lever in alignment with the aperture 142 and to cam the body 58' forward. This operation requires use of both hands of the operator.

Figure 9:
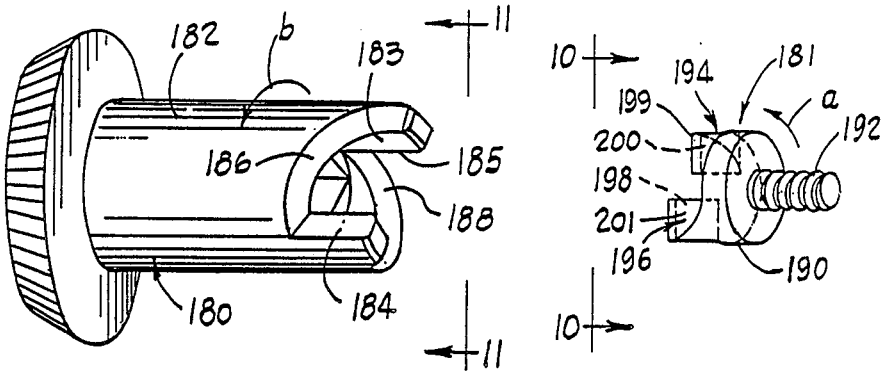
FIG. 9 is an enlarged partial perspective view of a second embodiment of a drive pinion and a drive adapter (disengaged) for the hand knife.
Figure 10:
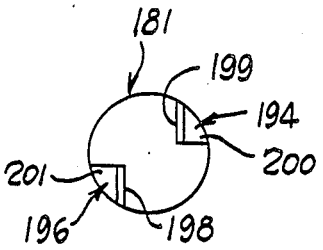
FIG. 10 is an view taken from line 10—10 of FIG. 9.
Figure 11:
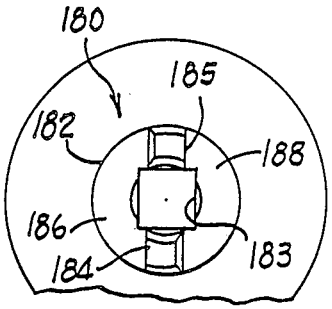
FIG. 11 is an end view taken from the line 11—11 of FIG. 9.

A modified pinion 180 is shown in FIGS. 9 and 11 constructed to be driven by an adapter 181 shown in FIGS. 9 and 10 that is secured to and functionally becomes the end of the shaft 68, which is shortened and modified from the structure of FIGS. 1, 2 and 8 to threadedly receive the adapter at the end extending from the body 58 or 58'. This modified pinion and adapter structure facilitates interengagement between the driving shaft and the pinion.

The pinion 180 has a hub 182 with a counterbore 183 and two flat parallel drive surfaces 184, 185 in the counterbored portion of the hub wall. The drive surfaces extend longitudinally of the hub, i.e., in the axial direction, and are oppositely facing to act as a couple for rotating the pinion about its central longitudinal axis when force is applied in a peripheral direction. Two oppositely located helical end surfaces 186, 188 of the hub provide peripheral clearance in front of each drive surface for the adapter 181 and facilitate interengagement between the adapter and pinion without requiring an initial accurate rotational alignment between the two.

The adapter 181 has a cylindrical body 190 with a central threaded boss 192 extending axially from one side, to be received in a threaded bore of the drive shaft, and with two drive fingers 194, 196 extending in the axial direction from the opposite side and located at the periphery of the body 190. Each finger has an axially extending driving surface 198, 199 adapted to abut the surfaces 184, 185, respectively, of the pinion. The fingers have a tapered contour 200, 201 behind each driving surface to provide clearance for the helical end surfaces 186, 188. Preferably, when the surfaces 198, 199 are engaged with the surfaces 184, 185, the adapter 181 does not exert an axial force against the pinion. When the surfaces 198, 199 of the adapter abut the surfaces 184, 185 of the pinion and the adapter is rotated in the direction of the arrow "a" it will rotate the pinion in the same direction as indicated by the arrow "b". Typically the driving surfaces will be received in peripherally spaced positions from the surfaces 184, 185 when the drive shaft is initially moved toward the pinion to engage it, and the inclined surfaces 200, 201 will tend to rotate the pinion slightly due to axial force applied as the adapter 190 is moved axially into an engagement position. This will bring the drive surfaces 184, 185 into close proximity to the surfaces 198, 199.

Figure 12:
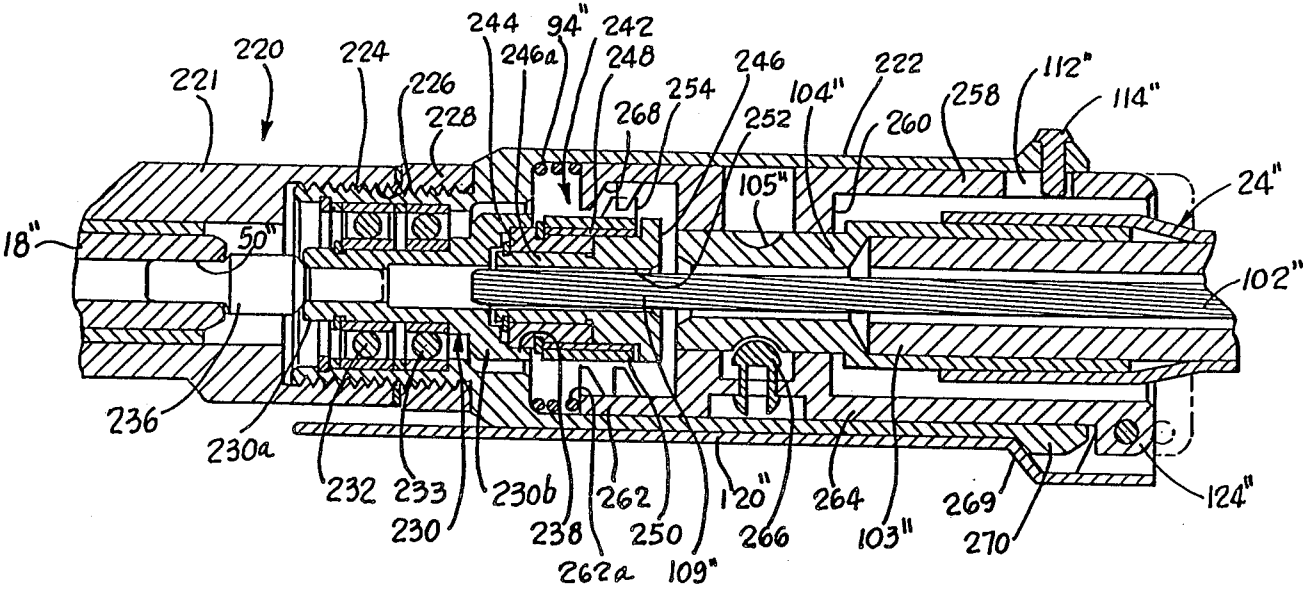
FIG. 12 is a partial longitudinal sectional view of another hand knife embodiment of the invention.

Another preferred embodiment of and best mode for carrying out the invention is shown in FIG. 12. A two-piece handpiece 220 driven by a cable drive 24'' is formed of a first piece 221 that supports a blade housing (not shown) identical to the housing 14 in FIG. 1 and a pinion 18'' identical to the pinions 18 and 18', and a second piece 222 with an externally threaded end 224 received in an internally threaded counterbore 226 of the first piece and held tightly by a jam nut 228. The shape and extent of the handpiece 220 is generally similar to the handpiece 12. For convenient comparison, parts of the modified handpiece and transmission that correspond with similar parts in the embodiment of FIGS. 1–6 are designated with the same reference numeral, but with a double prime (") designation.

A tubular spindle 230 is supported in the end 224 by bearings 232, 233. An adapter 236 with two square ends extends from one end **230*a* of the spindle into the square pinion recess 50''. An opposite end 230*b* of the spindle is of larger diameter and forms a recess 238**.

A clutch 242 is partially received with a press fit into the recess 238 so it is supported by the spindle. The clutch is a commercially available mechanical spring clutch and has four basic pars: an output hub 244 press fit into the recess 238, an input hub 246 having a journal portion **246*a* rotatably received in the output hub, a wire spring 248 wrapped about equal diameter, adjacent, axial portions of the two hubs, and a release sleeve 250 that fits over the spring. The input hub has a central passageway 252 square in cross section to receive the square end 109'' of a drive cable 102'' of a cable assembly 24'' by which the hub 246 is driven. One end of the spring is secured to the output hub. The other end has a toe 254 that extends radially outward. The spring is normally in frictional engagement with the outside surfaces of the two hubs and is wound in a direction so when the input hub 246 is rotated by the cable 102'' the spring will tighten about the output hub and the two hubs 244, 246** will rotate as a unit. If the toe is prevented from rotating, the spring cannot tighten to grip the input hub, and transfer of power to the output hub is prevented.

A tubular body 258, preferably of aluminum or plastic, is slidably received in the second piece 222 of the handpiece and has a groove 112'' that cooperates with a guide pin 114'' in the piece 222, in the manner the grooves and pins of the embodiment of FIGS. 1–6 or 7 cooperate, to permit installation and movement of the body. The groove 112'' allows limited longitudinal reciprocable motion of the body 258 within the piece 222 after installation.

The body 258 has a central portion 260 of smaller internal diameter than a front portion 262 or a rear portion 264. The central portion closely receives with a clearance fit a fitting 104'' that is retained by a pin 266 received in a circumferential groove 105'' to retain a sheath 103'' in fixed axial relationship with the body 258 while allowing relative rotation.

The front portion 262 receives and encircles the clutch 242. A front end **262*a* traps a coil compression spring 94'' between the body and the handpiece. In the solid line position shown in FIG. 12, the spring is compressed and one of a plurality of radially inwardly extending fingers 268 is forward of the spring toe 254, allowing the spring to tighten in response to rotation of the input hub. In the phantom line position shown, achieved when the body 258 slides rearward in the handpiece to the extent allowed by the pin 114'' and groove 112''**, a finger engages the toe and the spring cannot tighten.

A lever 120'' is pivoted to a boss 124'' on a portion of the body 258 that extends from the back end of the handpiece and is shaped at 269 to cooperate with a flange 270 on the handpiece and thereby retain the body in the solid line forward position shown in FIG. 12 when the lever is alongside the handpiece, as shown, and gripped by the knife operator. Thus, in the solid line position shown, rotation of the cable will be transmitted through the clutch to the spindle 230 and pinion 18'', but when the lever is released, the body will move rearwardly to the phantom position, positioning a finger 268 to stop rotation of the spring, preventing rotation of the knife blade. As in the embodiment of FIGS. 1–6, the cable drive assembly 24'' and body 258 can be easily removed from the handpiece, the cable end 109'' readily sliding out of the input hub 246.

From the foregoing description, it will be clear that assembly or disassembly of the body 58, 128, 58' or 258 with the cable drive assembly 24, 24' or 24'' is fast, convenient and positive. Handpieces or transmissions can be replaced individually in the event of wear or breakage and the transmissions are easily cleaned. This is important under requirements of the U.S. Department of Agriculture (USDA) for machines used in the meat industry. Most importantly, the transmissions are readily and conveniently engageable, but initial engagement requires the use of two hands, one to hold the handpiece and the other to move the body within the handpiece to a position where the drive is engaged and the lever is alongside the handpiece and engaged with a flange or pin on the handpiece. The transmissions will immediately disengage to prevent blade rotation if the handpiece and lever are released by the operator. No electrical connections are required that could be a source of electrical shock, especially in the environment in which the knives find primary use, and continued cable rotation after power to the drive motor is turned off cannot continue to rotate the knife blade once the handpiece is released by the operator.

While preferred embodiments of the invention have been described in detail, it will be understood that modifications or alterations can be made therein without departing from the spirit and scope of the invention set forth in the appended claims.

We claim:

1. A cable-driven rotary hand knife comprising a handpiece; a ring-like housing on the handpiece; a rotary ring blade with gear teeth; a rotary pinion supported in the handpiece and engaged with the gear teeth; and a drive transmission at least partially received within the handpiece, said transmission comprising a coupler having a rotary output element connected to the pinion, a rotary input element constructed to receive a rotary drive cable and means to selectively transmit rotation between the two elements, a movable member slidably received for relative motion within the handpiece, said member having means to receive and retain a cable and cable sheath, means cooperable with the handpiece for releasably retaining the member in the handpiece while allowing relative movement between first and second positions, means movable relative to the coupler to cause said elements to rotate together when said member is in said first position and to allow relative rotation between the two elements when said member is in said second position, and means biasing the member toward the second position; and means, including a retainer positioned to be gripped by an operator holding the handpiece, for retaining the member in the first position when said retainer is gripped and for allowing the member to move to the second position when released.

2. A rotary hand knife as set forth in claim 1 wherein said movable member and cable sheath are movable longitudinally together relative to the handpiece and are relatively rotatable.

3. A rotary hand knife as set forth in claim 1, 2, wherein one of the handpiece and said movable member has a groove and the other has a projection received in the groove, said groove and projection being constructed and arranged to permit insertion and removal of the movable member into the handpiece and to limit operating movement of said member relative to the handpiece after insertion.

4. A rotary hand knife comprising a handpiece, a ring-like housing on the handpiece, a rotary ring blade with gear teeth supported and guided by the housing, a rotary blade-driving member supported by the handpiece and having teeth engaged with the gear teeth, a body removably secured in the handpiece for relative movement toward and away from the blade driving member, a rotary drive shaft supported in the body for reciprocable movement into and out of driving engagement with the blade-driving member, means within the handpiece yieldably biasing the shaft out of driving engagement with the blade-driving member, and a hand-engageable means for retaining the shaft in driving engagement with the blade-driving member only when the handpiece and retaining means are gripped.

5. A rotary hand knife as set forth in claim 4 wherein the body includes means for receiving and retaining a drive-cable sheath, and said shaft has means for coupling it to a rotary drive cable.

6. A rotary hand knife as set forth in claim 4 wherein one of the body and handpiece has a groove and the other has a projection received in the groove, said groove and projection being constructed and arranged to permit insertion and removal of the body into a cavity of the handpiece and to allow limited movement of the body relative to the handpiece toward and away from the driving member.

7. A rotary hand knife as set forth in claim 4 or 5 wherein said means for retaining the shaft in driving engagement is carried with the drive shaft for movement relative to the handpiece and includes means to secure the drive shaft against movement out of engagement with the blade-driving member.

8. A rotary hand knife as set forth in claim 4 including means to secure a drive-cable sheath to the handpiece, wherein the body is reciprocable relative to the handpiece and sheath toward and away from the blade-driving member, and said shaft has means for coupling it to a rotary drive cable.

9. A rotary hand knife as set forth in claim 4 wherein the body and means on the handpiece are rotatable relative to each other and have interengaging surfaces that move the body toward the blade-driving member in response to relative rotation.

10. A cable driven rotary hand knife comprising a handpiece; a ring-like housing on the handpiece; a rotary ring blade with gear teeth; a rotary pinion supported in the handpiece and engaged with the gear teeth; and a drive transmission at least partially received within the handpiece, said transmission comprising a body, a drive shaft rotatably supported by the body, extending therefrom and coupleable in driving engagement with the pinion, and means at the other end of the drive shaft for coupling with a driving end of a rotary drive cable; means providing limited movement of the drive shaft relative to the handpiece between a first position in which it drives the pinion and a second position in which it does not drive the pinion; means biasing the shaft toward the second position; and means, including a member positioned to be gripped by an operator holding the handpiece, for retaining the shaft in the first position when said member is gripped and for allowing the shaft to move to the second position when released.

11. A rotary hand knife as set forth in claim 10 wherein said means for coupling a drive cable sheath is carried by the body.

12. A cable driven rotary hand knife comprising a handpiece; a ring-like housing on the handpiece; a rotary ring blade with gear teeth; a rotary pinion supported in the handpiece and engaged with the gear teeth; a drive surface on the pinion; and a drive transmission at least partially received within the handpiece and removable therefrom as a unit, said transmission comprising a body, a drive shaft rotatably supported by and axially fixed in the body, extending therefrom and engageable at one end in driving relationship with the pinion, a drive surface at the other end of the drive shaft for engagement by a rotary drive cable, a recess in the body aligned with the drive shaft for receiving a distal end of a drive-cable sheath, means for releasably securing the end of a drive cable sheath in the body; means receiving the body in the handpiece for limited movement relative to the handpiece between a forward position toward the pinion and a back position away from the pinion sufficient to engage and disengage the drive shaft and pinion; a spring carried by the body acting between the handpiece and the body, biasing the body to the back position; and means on the handpiece located to be gripped by an operator holding the handpiece to retain the body in the forward position.

13. A hand-held cable-driven rotary cutter comprising a handpiece, a rotary blade supported by the handpiece, a rotary blade-driving member engaged with the blade, a passageway in the handpiece opening through one end thereof remote from the blade, means at least partially received within the passageway for selectively coupling a rotary flexible cable in driving relationship with the blade-driving member, said means including a member slidable into and out of the passageway through the opening at said one end for assembly and movable after assembly within the passageway between a first position where the coupling means drivingly connects the rotary cable to the blade-driving member and a second position where the coupling means does not, means to bias said movable member to the second position, and control means to retain said movable member in the first position when gripped and to allow said movable member to move to the second position when released.

14. A cable-driven rotary hand knife comprising a handpiece, a rotary blade supported by the handpiece, a rotary blade-driving member engaged with the blade, means at least partially within the handpiece for selectively coupling a rotary cable in driving relationship with the blade-driving member, said means including a member movable between a first position where the coupling means drivingly connects the rotary cable to the blade-driving member and a second position where the coupling means does not, means to bias said movable member to the second position, and control means to retain said movable member in the first position when gripped and to allow said movable member to move to the second position when released, one of the handpiece and said movable member having a groove and the other having a projection received in the groove, said groove and projection being constructed and arranged to permit insertion and removal of the movable member into the handpiece and to limit operating movement of said member relative to the handpiece after insertion.

15. A rotary hand knife comprising a handpiece, a ring-like housing on the handpiece, a rotary ring blade with gear teeth supported and guided by the housing, a pinion supported by the handpiece and having teeth engaged with the gear teeth, a rotary driven member couplable to the pinion, rotary drive means including a flexible cable received in the hand piece, means including a member reciprocably movable within the handpiece between first and second positions to respectively couple and uncouple the rotary driven member to the pinion, means to bias the reciprocable member to the second position, and hand-grippable means to retain the reciprocably movable member in the first position when gripped and to allow the reciprocably movable member to move to the second position when released one of the handpiece and said movable member having a groove and the other having a projection received in the groove, said groove and projection being constructed and arranged to permit insertion and removal of the movable member into the handpieces and to limit operating movement of said member relative to the handpiece after insertion.

16. A rotary hand knife comprising a handpiece, a rotary blade supported by the handpiece, a rotary blade-driving member engaged with the blade, a rotary drive shaft supported in the handpiece and engaged with the blade-driving member, a coupler having a rotary output element connected to the drive shaft, a rotary input element constructed to receive a rotary drive cable and means to selectively transmit rotation between the two elements, a member for operating said coupler, movable between a first position to cause said elements to rotate together and a second position to allow relative rotation between the two elements, means to bias the member to said second position, and hand-grippable means to retain the member in the first position when gripped and to allow the member to move to the second position when released, one of the handpiece and said movable member having a groove and the other having a projection received in the groove, said groove and projection being constructed and arranged to permit insertion and removal of the movable member into the handpiece and to limit operating movement of said member relative to the handpiece after insertion.

17. A hand knife as set forth in claim 13, 14, 15 or 16 wherein said movable member includes means for receiving and retaining a drive-cable sheath.

* * * * *